US005815850A

United States Patent [19]

Shon

[11] Patent Number: 5,815,850

[45] Date of Patent: Oct. 6, 1998

[54] METHOD AND APPARATUS FOR CHEMICAL DISPENSING INTO TOILET BOWL

[76] Inventor: Adrian Y. Shon, 1621 Baltimore Pl., Escondido, Calif. 92025

[21] Appl. No.: 789,282

[22] Filed: Jan. 28, 1997

Related U.S. Application Data

[63] Continuation-in-part of Ser. No. 610,527, Mar. 4, 1996, abandoned.

[51] Int. Cl.[6] ..... E03D 9/02

[52] U.S. Cl. ..... 4/225.1; 137/268; 137/441

[58] Field of Search ..... 4/222, 222.1, 223, 4/224, 225.1, 226.1, 227.1, 227.4, 227.5; 137/268, 441

[56] References Cited

U.S. PATENT DOCUMENTS

| | | | |
|---|---|---|---|
| 2,570,934 | 10/1951 | Foster | 4/225.1 |
| 3,105,245 | 10/1963 | Finkbiner | 4/225.1 |
| 3,290,698 | 12/1966 | Joyner et al. | 4/255.1 |
| 3,311,931 | 4/1967 | Kristensen et al. | 4/225.1 |
| 3,444,566 | 5/1969 | Spear | 4/225.1 |
| 3,911,507 | 10/1975 | Johnson | 4/224 |
| 4,117,560 | 10/1978 | Kidon et al. | 4/222 |
| 5,042,095 | 8/1991 | Schoepe et al. | 4/225.1 |
| 5,125,119 | 6/1992 | Munoz | 4/225.1 |
| 5,441,711 | 8/1995 | Drewery | 137/268 |

*Primary Examiner*—Charles R. Eloshway

[57] ABSTRACT

A toilet bowl cleansing apparatus is positioned in a toilet tank between the toilet bowl refill tube and overflow protection pipe. The apparatus comprises a sealed container having an inlet connected to the refill tube and an outlet communicating with the overflow pipe. The interior of the container is divided into two chambers by a partition having screens at each end. One chamber houses a block of cleansing agent and the other chamber allows ingress of water into the container. As water from the refill tube enters ingress chamber, it flows through one of the screens in the partition and mixes with part of the cleansing agent block to form a cleansing solution. Compression of the air in the container permits only a portion of the block to erode at a time since the internal pressure forces the solution to exit the container before the block is completely covered by water.

7 Claims, 5 Drawing Sheets

METHOD AND APPARATUS FOR CHEMICAL DISPENSING INTO TOILET BOWL

RELATED APPLICATIONS

This Application is a Continuation-In-Part of application Ser. No. 08/610,527 Filing Date: Mar. 4, 1996, now abandoned.

BACKGROUND—DISCUSSION OF PRIOR ART

The typical conventional toilets include a toilet bowl and a reservoir tank. The water in the reservoir tank supplies flushing water to the bowl and itself is supplied water from the water line of the home. The way in which a conventional toilet works is simple. A control lever, manually activated, lifts open the flapper valve and the content of the reservoir (water) is released into the bowl. When the reservoir tank is empty the flapper valve automatically closes. A water level sensor detects the absence of water in the tank and activates the flow of water to fill the reservoir tank. During this tank fill time, a portion of the water is diverted into the toilet bowl fill tube. The water in this tube, which is inserted into the overfill protection pipe, fills the toilet bowl to the proper level during the reservoir tank fill duration. When the water level sensor detects that the tank has been filled to the proper level, it shuts off the water flow.

In the field of delivering toilet bowl deodorizer chemicals in conventional gravity type toilets, U.S. Pat. No. 2,570,934 is a design that directs the flow of toilet bowl fill water into a chamber that contains the cake of deodorizer. This design, however, does not control the flow of water or the dissolution rate of the chemical compound. Also, the coil spring employed to prevent pieces of the deodorant cake from entering the toilet bowl may cause water to be retained in the container and permit the continual dissolving of the solid chemical deodorant between flushes.

U.S. Pat. No. 3,911,507 controls the water flow into a device that contains the water soluble detergent via a screw valve. Also, the detergent solution flows out of the device mixing chamber into the overflow tube whenever new water is introduced. Since the water that is being controlled is normally used to fill the toilet bowl to the proper level, any restriction would cause the toilet bowl water level to vary from the norm which could cause improper flushing action. This design also relies on the chemical in the apparatus being immersed in water all the time. Assuming an initial solid type of chemical, the concentration of the chemicals in solution within the apparatus could vary widely depending on the amount of time it takes for the solid chemical to dissolve completely. Also, once it is completely dissolved, the concentration of the chemical detergent going to the toilet bowl gets weaker and weaker each time water is added to the container.

U.S. Pat. No. 3,290,698 is a complex device that uses part of the toilet bowl fill water to spray over the chemicals contained therein and yet the bulk of the water can be conducted around the chemicals, to reduce the rate of dissolving of the chemicals. This device is complex to manufacture by comparison to the new proposed invention. Also, it cannot provide a constant concentration of chemical solution to the toilet bowl because the spray is a directed force of water which, having acted on the chemicals within its path, cannot be redirected onto a new spot to act on other areas of the chemical block.

U.S. Pat. No. 3,444,566 is a relatively large, complex and cumbersome device which relies on multiple chambers and siphoning action. It would be difficult to install in many conventional toilets because of its size and configuration. The siphoning action described can cause water to be retained within the device that would cause the continual dissolving of the solid chemical into the trapped water within the device. Depending on the time between flushes, this action can cause a wide variation of the chemical concentration to be delivered to the toilet bowl.

U.S. Pat. No. 3,311,931 is a device that continuously immerses the chemical in water in a compartment. When the toilet tank is filling, water from the toilet bowl fill tube is added to the compartment containing the chemical solution and causes the solution to overflow into the overfill protection pipe into the toilet bowl. This is a simple method but it causes the solid chemical within the device to continually dissolve, limiting the life of the chemical. Thereby the chemical concentration being delivered to the toilet bowl varies greatly depending on the duration of time between flushes—the longer the duration between flushes, the higher the concentration of the chemical solution being delivered to the toilet bowl.

U.S. Pat. No. 5,125,119 is part of a larger toilet deodorizer system. It describes a device that uses the toilet bowl fill tube water to be directed into a cake like chemical in a compartment. This method of water delivery causes a wide concentration of solutions to be delivered to the toilet bowl. This is because the water if directed onto the cake will quickly erode the chemical cake and the size of the cake remaining will determine the concentration of the solution delivered to the toilet bowl. On the other hand, if the water does not initially come into direct contact with the chemical cake, it will not ever do so and will not dissolve that portion of the chemical cake. This design does not allow any temporary partial filling of the device with water to permit eventual contact with all the chemical cake.

In contrast to these prior inventions, this new invention does not immerse the chemical agent in water from the end of tank fill to the next toilet flush. It is compact, simple in design, economical to manufacture, and easy to use in a wide range of conventional toilets. When flushing starts, water from the bowl fill small tube is directed into the input/output chamber of the dispenser. The flow of water into the compartment is controlled so that the normal outlet flow of water from the chamber is prevented by the action of the incoming water passing perpendicularly over the outlet opening. When there is sufficient pressure buildup, due to the partial filling of water within the enclosed device, water will begin to flow out the outlet tube. This controlled filling of the device with water causes the water to come into contact, in a controlled way, with only the bottom portion of the solid chemical within the chemical compartment via a screen at the far end. As the bottom of the chemical block dissolves, the chemical block settles, replacing the portion that has been used. Hence, the water comes into contact with a fairly constant mass of solid chemical during the flushing cycle. This liquid flow around the base of the chemical block is controlled by; (1) the different sizes of the chambers where the input/output (I/O) chamber is smaller to insure the water can enter and partially fill the adjoining chemical chamber; (2) the sizes and locations of the partition screens to let the water enter the chemical chamber and return; and (3) placing the solid chemical on rails to let water flow under the chemical block. This chemical mixture is then routed into the toilet bowl via the overfill protection pipe. It flows into the toilet bowl and stops when the toilet tank filling is completed. When the water flow stops, the remaining water within the dispenser drains out. Thus the solid chemical within this invention is not immersed in water between flushes.

OBJECTIVES AND ADVANTAGES

Accordingly, several objectives and advantages of my invention are:

1. BETTER MIXTURE CONTROL—This invention is an enclosed device, except to permit water egress and exit, that uses water flow and pressure in a unique way for a more uniform water and chemical solid interaction. The design also insures the interaction of all of the chemical solid with water over time by only permitting the bottom portion of the chemical solid to come into contact with the water. As the bottom portion of the chemical solid is used, the block of chemical solid moves down to maintain the solid chemical to water solution transfer rate.
2. EASIER TO USE—Simple to install in a wide variety of conventional toilets based on its small size and configuration and the use of the mounting adapter where necessary.
3. MOST ECONOMICAL TO MANUFACTURE—This device is designed for ease of manufacture. The device (without the chemical block) is composed of a small number of injected molded plastic parts—the shell, the internal partition/partial screen and the mounting adapter.

DRAWING FIGURES

LIST OF REFERENCE NUMERALS

1=toilet tank
2=bowl fill tube
3=cleanser dispensing device or apparatus
5=overflow pipe
7=input tube
8=output tube
9=output strut
10=I/O chamber
11=cleanser chamber
12=cleanser block
14=partition
15=cleanser rail
16=small screen
18=large screen
20=overflow adapter
21=cleanser chamber divider
22=cleanser block.

DESCRIPTION OF THE PREFERRED EMBODIMENTS

Figure 1:
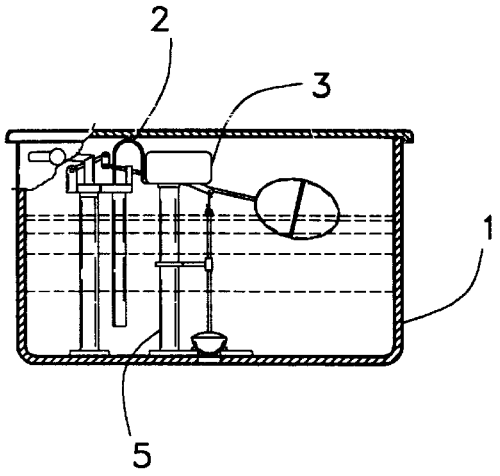
FIG. 1 is a front view in partial cross section of a toilet assembly water tank including an apparatus of the invention on the overflow pipe.
Figure 4:
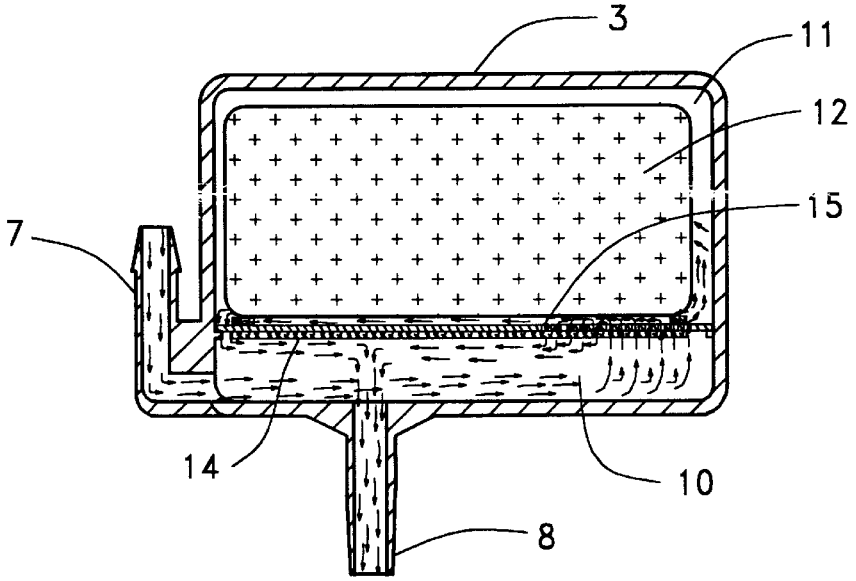
FIG. 4 is the cross sectional view taken along line A—A of FIG. 2.

The present invention pertains to an apparatus, a cleanser dispensing device(3) that utilizes the water that normally flows, during the flush/tank fill cycle of a typical toilet tank(1), into the overflow pipe(5) as shown in FIG. 1. This water in the bowl fill tube(2) enters the cleanser dispensing device(3) I/O (input/output) chamber(10) by way of the smaller diameter input tube(7) in such a way as to pass swiftly across the outlet opening of the larger diameter output tube(8) as shown in FIG. 4. This water directed action hinders the outflow of water and causes the water to temporarily remain within the enclosed cleanser dispensing device(3). The volume of the I/O chamber(10) is small in comparison to the cleanser chamber(11) as shown in FIG. 4 so that the water partially fills the cleanser chamber(11). As the water volume and pressure builds up within the enclosed apparatus(3), the trapped air within the cleanser chamber (11) lets only the lower portion of the solid cleansing block(12) to come into contact with the water flowing in from the large screen(18) area. The large screen(18) area is big enough to permit the flowing water to enter the cleanser chamber(11) at the far end of the I/O chamber(10) to mix with the cleanser block(12) and return back into the I/O chamber(10) through the area near the mid section of the I/O chamber(10). The cleanser rail(15) upon which the cleanser block(12) rests and the size of the cleanser block(12) (smaller in size than the cleanser chamber(11)) aids the water within the cleanser chamber(11) to flow towards the input tube(7) end, mixing with the lower portion of the cleanser block(12) in the process, and returning to the I/O chamber(10) through the small screen(16) at that end. Since only the bottom portion of the cleanser block(12) is exposed to the water flow, it slowly erodes away. That eroded portion is replaced by the remaining cleanser block(12) settling into place providing for a relatively constant water-cleanser block(12) interface. When increased pressure within the device(3) overcomes the negative pressure in the internal opening of the outlet tube(8) the water-cleanser solution flows readily into the outlet tube(8) to the overflow pipe(5) to the toilet bowl.

Figure 9:
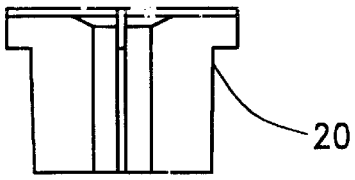
FIG. 9 is the front view of the overflow adapter.
Figure 10:
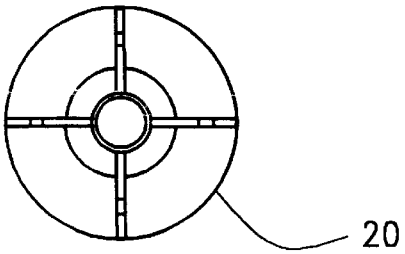
FIG. 10 is the bottom side view of the overflow adapter.
Figure 11:
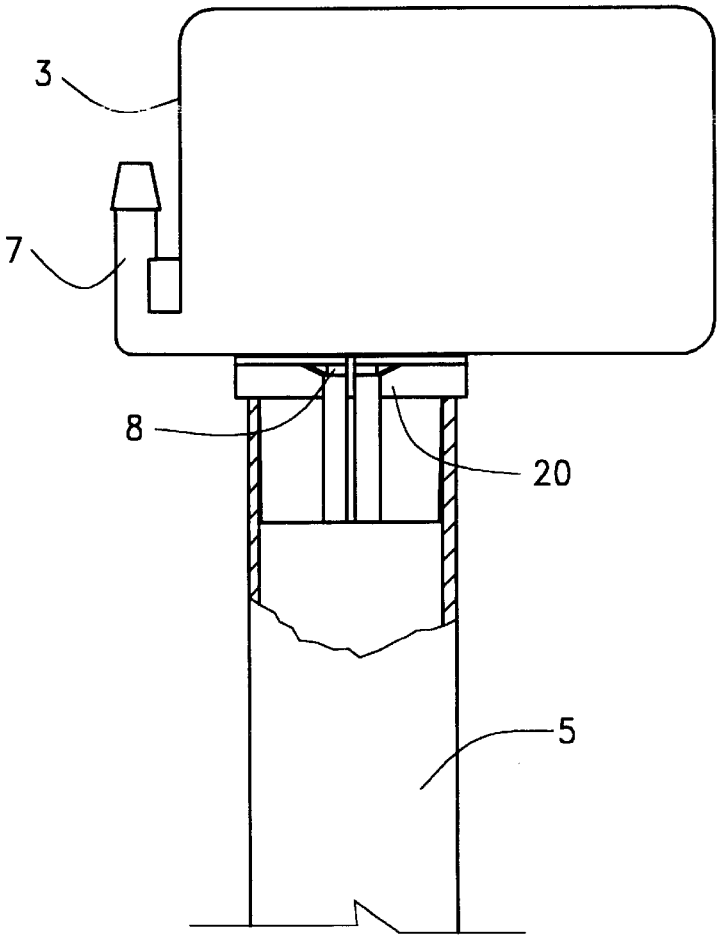
FIG. 11 is a cutaway of the overflow pipe showing the use of the overflow pipe adapter with the invention.

In order to easily install the device into existing conventional toilets, variations in the overflow pipe(5) openings must be accommodated. The overflow pipe(5) for conventional toilets varies in two basic ways. In one case, the overflow pipe(5) contains a small orifice where the toilet bowl fill tube(2) is normally inserted. In the other case, there is no bowl fill tube(2) orifice and the bowl fill tube(2) is inserted and mechanically clamped to the inside of the overflow pipe(5). In the first case, the output pipe(8) of the device(3) is inserted into the small opening for the bowl fill tube(2). In the latter case the overflow adapter(20), shown in FIGS. 9 and 10, is inserted into the overflow pipe(8). The overflow adapter(20) has a small opening into which the output tube(8) of the chemical dispensing device(3) is inserted as shown in FIG. 11.

Figure 12:
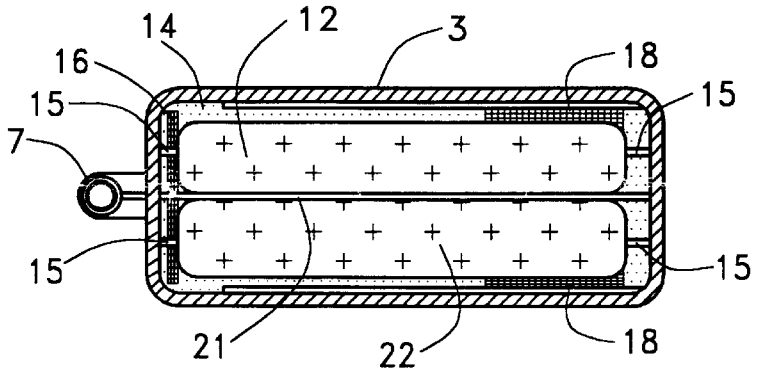
FIG. 12 is the cross sectional view taken along line C—C of FIG. 3 for an apparatus with a wall that divides the cleanser chamber into two separate compartments.
Figure 13:
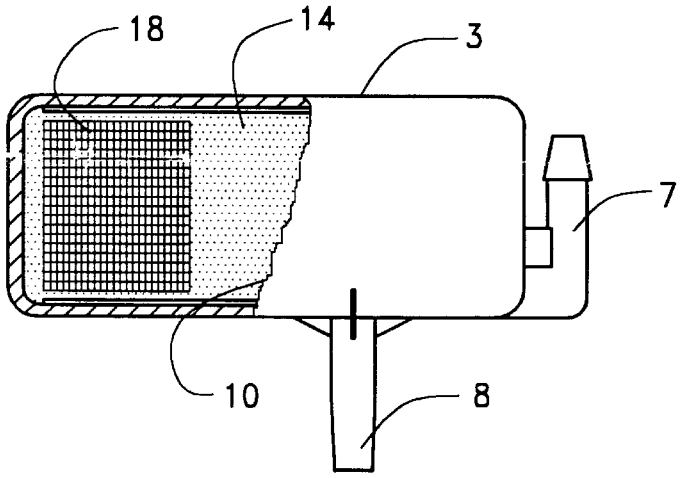
FIG. 13 is the front view of the alternate configuration of the invention with a cut away showing the I/O chamber and the partition with screens.
Figure 14:
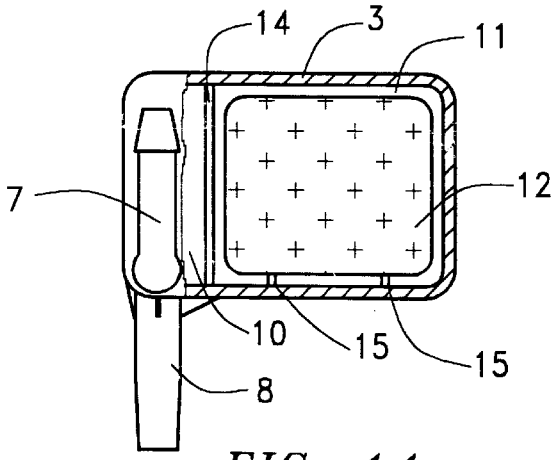
FIG. 14 is the right end view of the alternate configuration of the invention with a cut away showing the I/O chamber, the partition, the chemical chamber, the cleanser rail and the cleanser block.
Figure 15:
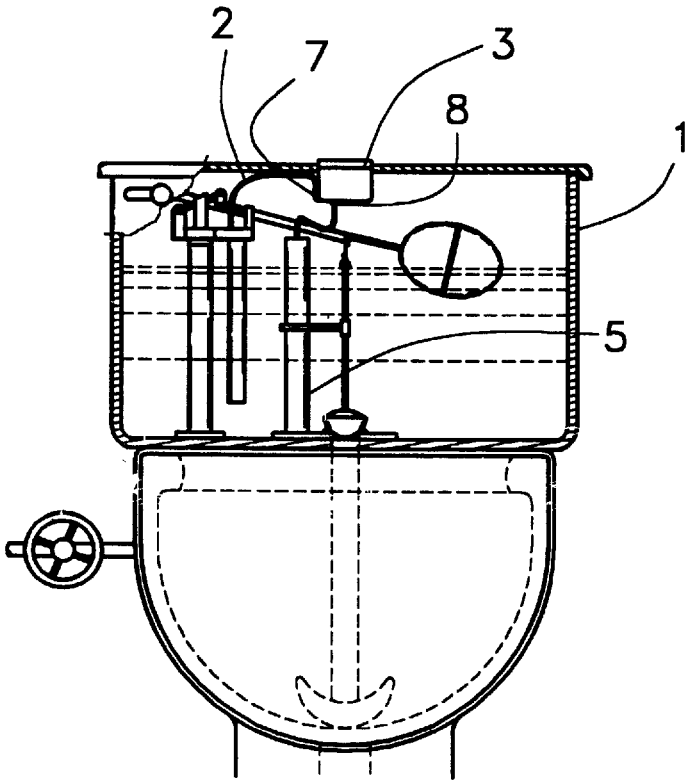
FIG. 15 is a front view in partial cross section of a toilet assembly water tank including an apparatus of the invention mounted to the wall of the toilet tank.

The internal configuration of the solid agent dispensing unit(3) depicted is only one example from many possible configurations. Some of the variations are as follows:

(a) Vary the large screen(18) area based on the hardness of the cleansing agent where the more insoluble the chemical cleanser block(12), the greater the large screen(18) area should be for more interaction between the water and the cleanser block (12) to maintain the chemical solution concentration desired;

(b) Using a cleanser chamber divider(21) to divide the chemical chamber into two parts so that two types of cleansers, cleanser block(12) and cleanser block (22), sit side by side separated by the cleanser chamber divider(21) as shown in FIG. 12;

(c) Placing the cleanser chamber(11) on one side of the I/O chamber(10) instead of on top of it as depicted in FIG. 13 which shows a cut away front view of the cleanser dispensing device(3) showing the I/O chamber (10) and the partition(14) with the large screen(18), and a right side view in FIG. 14 cut away showing the I/O chamber(10), the partition(14), the cleanser chamber (11), the cleanser block(12) and most importantly the input tube(7) and output tube(8) maintaining their physical position relationship to each other to insure proper water and drainage control;

(d) Placing the apparatus(3) on the inside wall of the toilet tank(1) as shown in FIG. 15 (using water proof tape or a bracket arm) instead of on top of the overflow pipe(5) such that the water chemical mixture flowing out of the cleanser dispensing device(3) is routed into the overflow pipe(5) via a tubing with one end connected to the output tube(8) with the other end placed in the overflow pipe(5).

Figure 2:
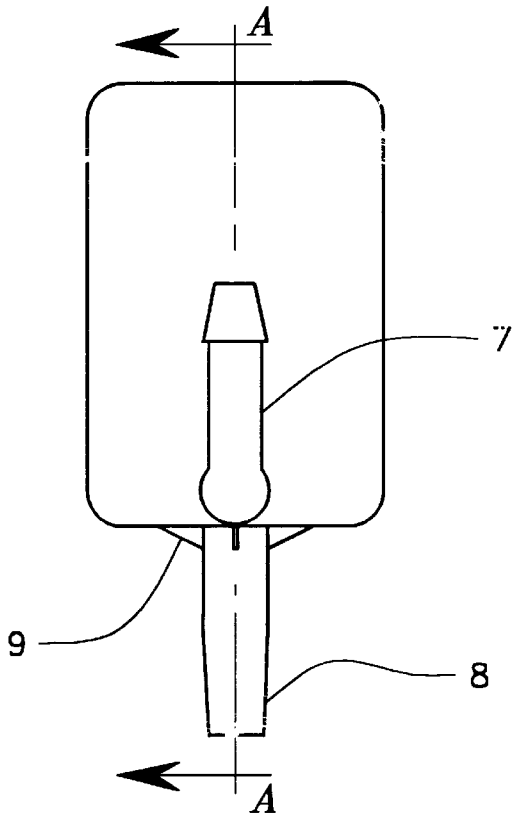
FIG. 2 is the right side view of the invention.
Figure 3:
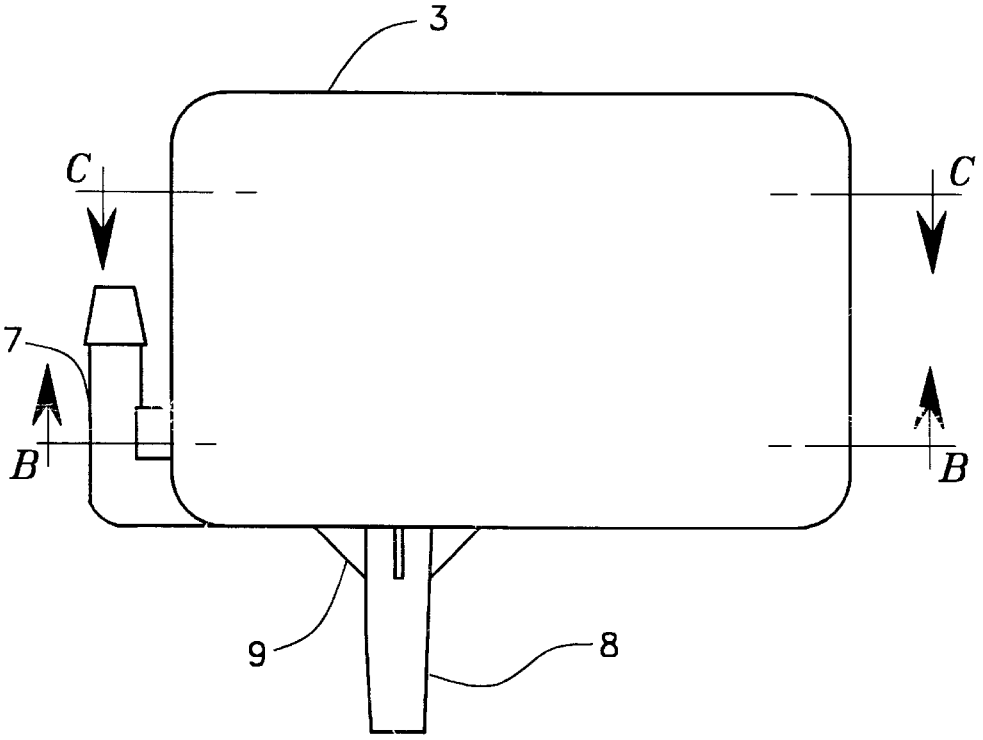
FIG. 3 is the front view of the invention.

The typical toilet tank configuration is shown in FIG. 1 and the detail of how it works has been covered in the first paragraph of "BACKGROUND—DISCUSSION OF PRIOR ART." FIG. 1 also shows the cleanser dispensing device(3) of the preferred embodiment using the conventional toilet bowl fill water that flows in the toilet bowl fill tube(2) and sitting atop the overflow pipe. FIG. 2 and FIG. 3 show two views of the cleanser dispensing device(3) preferred embodiment where FIG. 2 shows the right side view and FIG. 3 shows the front side view. The way the solid cleanser device(3) preferred embodiment works is shown in FIG. 4. During a flush and toilet tank(1) fill period, the water in the toilet bowl fill tubing(2) enters the cleanser dispensing unit(3) I/O chamber(10) by way of the smaller diameter input tube(7), and is channeled to pass directly over the opening of the larger diameter output tube(8). This action prevents the water from easily exiting out the output tube(8) and permits the build up of water volume in the enclosed cleanser device(3). The initial flow of water within the I/O chamber(10) travels to the right and enters the cleanser chamber(11) through the large screen(18). The water flows from the I/O chamber(10) into the cleanser chamber(11) because of the smaller size of the I/O chamber(10) but does not fill the cleanser chamber(11) because the air trapped within the larger cleanser chamber(11) prevents the water from filling the cleanser chamber(11). The cleanser block (12) is of smaller size than the cleanser chamber(11) and rests on two partition rails(15). This configuration permits the water to flow under and around the base of the cleanser block(12) towards the left in the cleanser chamber(11) and flow back into the I/O chamber(10) via the small screen(16) and the left end portion of the large screen(18). The increased water pressure then causes the solution to flow out the outlet tube(8) into the overflow pipe(5).

Figure 5:
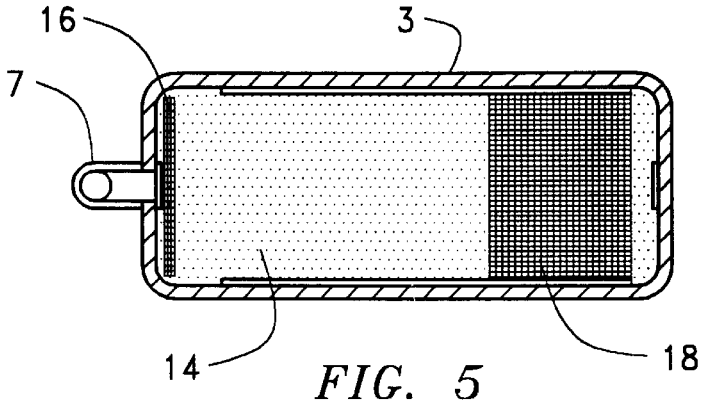
FIG. 5 is the cross sectional view taken along line B—B of FIG. 3.

FIG. 5 which is a cross sectional view taken along line B—B of FIG. 3 shows the under side of the partition(14) with the small screen(16), large screen(18) and cleanser rail(15).

Figure 6:
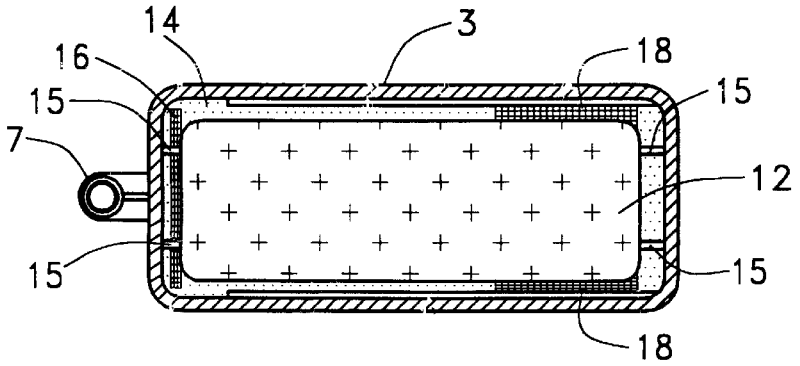
FIG. 6 is the cross sectional view taken along line C—C of FIG. 3.

FIG. 6 which is a cross sectional view taken along line C—C of FIG. 3 shows the relative size of the cleanser block(12) being smaller than the chemical chamber(11) to permit the cleanser block(12) to settle downward as the bottom portion of the cleanser block(12) erodes due to the water action.

Figure 7:
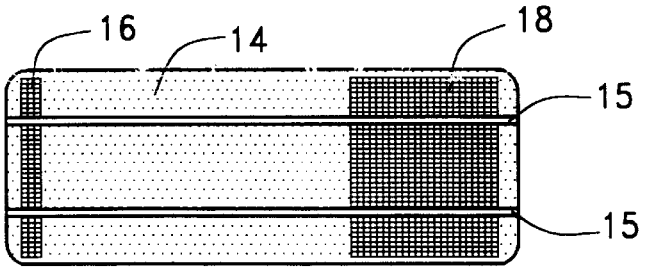
FIG. 7 is the front view of the partition with screens and rails.
Figure 8:
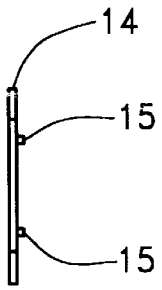
FIG. 8 is the left edge side view of the partition with rails.

FIGS. 7 and 8 are two views of the partition(14) showing the position of the large screen(18), the small screen(16) and the two cleanser rails (15). The large screen(18) area would vary depending on the solubility of the solid cleanser block. The screens(16,18) are shown as meshes but can be replaced with an equivalent open area of small round holes or narrow slits without changing the functionality of the apparatus.

FIGS. 9 and 10 show two views of the overflow adapter (20) where FIG. 9 shows the side view and FIG. 10 shows the bottom view.

FIG. 11 is a cutaway of the overflow pipe(5) showing the overflow adapter(20) inserted into the open end of the overflow pipe(5) with the cleanser dispensing device(3) output tube(8) inserted into the overflow adapter(20).

What is claimed:

1. A toilet bowl cleansing apparatus adapted to be located in a toilet tank, said toilet tank including a toilet bowl water refill tube and an overflow tube, said apparatus comprising:

an airtight, sealed container having an inlet adapted for connection to said refill tube and an outlet connected to an outlet tube adapted for connection to said overflow tube;

a partition in said container for dividing said container into an inlet/outlet chamber and a chemical mixing chamber, said inlet/outlet chamber being smaller than said chemical mixing chamber, said partition having a near end proximate said inlet and an opposite distal end;

a screen in each end of said partition;

a plurality of rails located in said chemical mixing chamber;

a block of cleansing agent supported on said rails in said chemical mixing chamber, whereby, when the toilet is flushed, water enters said inlet/outlet chamber through said refill tube and said inlet and flows swiftly across said outlet, hindering the outflow of refill water therethrough and causing the water entering the inlet/outlet chamber to flow through the screen at the distal end of the partition and into the chemical mixing chamber, the water entering the chemical mixing chamber mixing with the cleansing agent to form a cleansing solution, the continuous flow of water into the sealed container compressing air trapped in said container until equilibrium is established, whereupon the solution is forced through the screens at the near and distal ends of said container, into said outlet and outlet tube, said overflow tube, and then into said bowl, said compressing of trapped air ensuring that the water entering said chemical mixing chamber does not fill the entire chamber so that only a predetermined portion of the block of cleansing agent is eroded during a flush.

2. The cleansing apparatus of claim 1 wherein said screen at said distal end of said partition is larger than said screen at said near end of said partition.

3. The cleansing apparatus of claim 1 wherein said partition is positioned horizontally in said container such that said chemical mixing chamber is located above said inlet/outlet chamber, said rails being connected to the upper surface of said partition.

4. The cleansing apparatus of claim 1 wherein said partition is positioned vertically in said container such that said chemical mixing chamber is positioned forward of said inlet/outlet chamber, said rails being connected to a bottom wall of said container.

5. The cleansing apparatus of claim 1 further including a second partition for dividing the chemical mixing chamber into two separate chemical mixing chambers.

6. The cleansing apparatus of claim 1 further including an overflow tube adapter connected to said outlet tube for supporting said apparatus on said overflow tube.

7. The cleansing apparatus of claim 1 further including means for supporting said apparatus on a wall of the toilet tank and a conduit for connecting said outlet tube with said overflow tube.

* * * * *